US007804233B1

(12) United States Patent
Sundhar et al.

(10) Patent No.: US 7,804,233 B1
(45) Date of Patent: Sep. 28, 2010

(54) LIGHT BULB AND METHOD OF USE

(76) Inventors: Shaam P. Sundhar, 6 Tall Timbers Dr., Princeton, NJ (US) 08540; Totada R. Shantha, 115 Bayberry Hills, McDonough, GA (US) 30253; Theodore T. Masters, 5121 Spicewood Dr., Charlotte, NC (US) 28227

( * ) Notice: Subject to any disclaimer, the term of this patent is extended or adjusted under 35 U.S.C. 154(b) by 105 days.

(21) Appl. No.: 12/220,571

(22) Filed: Jul. 25, 2008

Related U.S. Application Data

(60) Provisional application No. 61/003,701, filed on Nov. 19, 2007, now abandoned.

(51) Int. Cl.
*H01J 1/88* (2006.01)
*H01J 19/42* (2006.01)

(52) U.S. Cl. ..... 313/272; 313/318.01; 313/578

(58) Field of Classification Search ..... 313/271–274, 313/318.01, 578
See application file for complete search history.

(56) References Cited

U.S. PATENT DOCUMENTS 2,100,195 A * 11/1937 Lowry ..... 327/598
4,463,277 A * 7/1984 DeCaro ..... 313/25
4,654,560 A * 3/1987 Cote ..... 315/49
4,912,364 A * 3/1990 Hollo et al. ..... 313/623
6,227,912 B1 * 5/2001 Hung ..... 439/620.02
6,611,102 B2 * 8/2003 Kimoto et al. ..... 313/637
6,713,966 B2 * 3/2004 Shultz et al. ..... 315/77
6,744,187 B1 * 6/2004 Wimberly ..... 313/110
6,856,090 B2 * 2/2005 Weyhrauch ..... 313/578
6,919,684 B2 * 7/2005 Brandes ..... 313/578
6,979,230 B2 * 12/2005 Cherian ..... 439/662
7,097,319 B2 * 8/2006 Mauk et al. ..... 362/147
7,214,105 B1 * 5/2007 Trerotola ..... 439/703
2003/0184223 A1 * 10/2003 Weyhrauch ..... 313/578
2003/0218426 A1 * 11/2003 Shultz et al. ..... 315/86
2004/0042228 A1 * 3/2004 Mitobe et al. ..... 362/510
2004/0157495 A1 * 8/2004 Cherian ..... 439/666
2005/0042927 A1 * 2/2005 Cherian ..... 439/611
2005/0116650 A1 * 6/2005 Baarman ..... 313/635
2005/0141232 A1 * 6/2005 Chon et al. ..... 362/509
2005/0201082 A1 * 9/2005 Mauk et al. ..... 362/147
2005/0248251 A1 * 11/2005 Hsu ..... 313/318.01
2006/0110984 A1 * 5/2006 Cherian ..... 439/662
2006/0226783 A1 * 10/2006 Lamouri et al. ..... 313/637
2007/0159838 A1 * 7/2007 Ladd ..... 362/509

* cited by examiner

*Primary Examiner*—Bumsuk Won
(74) *Attorney, Agent, or Firm*—Ted Masters

(57) ABSTRACT

A light bulb includes two or more filaments. When one filament burns out another filament can be connected so that the light bulb is still operational and does not have to be discarded.

2 Claims, 5 Drawing Sheets

LIGHT BULB AND METHOD OF USE

CROSS REFERENCE TO RELATED APPLICATION

This application claims the filing benefit under 35 U.S.C. §119(e) of U.S. Provisional Application No. 61/003,701, filed Nov. 19, 2007 now abandoned, which is herein incorporated by reference.

TECHNICAL FIELD

The present invention generally pertains to light bulbs, and more particularly to a light bulb which has at least two filaments. When one filament burns out, another filament can be connected so that the light bulb remains operational.

BACKGROUND OF THE INVENTION

The light bulb was invented in 1879 by Thomas Edison. This invention literally changed the way we lead our life at both home and at work, and contributed substantially to the industrial revolution. However, the original incandescent light bulb design has hardly changed over the years, and modern day bulbs still provide about 10 to 12 lumens per watt with an average life of 1,000 hours. In an incandescent light bulb, the filament represents about 15% of the manufacturing cost. The glass bulb, metal cap, epoxy, solder, raw material and energy used in making the bulb are the remaining 85%. But when this 15% cost filament burns out, people throw away the whole bulb including the good 85%. This creates monumental waste of good raw materials and the energy.

Of late, energy and environmental concerns are causing designers to adopt new lighting technologies such as the Compact Fluorescent Lamp (CFL). This light bulb has a higher efficiency (lumens/watt) than the incandescent light bulb, however it currently accounts for only 5% of electrical illumination market. The reasons are many. The phosphorus light radiation is unnatural and disliked by many. CFLs contain the environmentally hazardous material mercury and has many health concerns including landfill contamination. A dimmer switch may not be used on most of the CFLs. And finally, the cost of a good CFL is several times more than an incandescent bulb.

BRIEF SUMMARY OF THE INVENTION

The present invention is directed to a light bulb which has more than one filament. When a first filament burns out, the consumer can activate a second filament and continue to use the same light bulb. This is done by simply unscrewing the light bulb, changing the position of a switch or conductor located on the base of the light bulb, and screwing the light bulb back into the socket. The present invention solves the previously mentioned problems associated with both conventional incandescent light bulbs and CFL. Specifically, the present invention:

is cost effective to both the manufactured and consumer;

is convenient and simple to use;

reduces the consumption of raw materials and energy;

reduces landfills; and, avoids toxic waste.

In accordance with a preferred embodiment of the invention, a light bulb includes a first filament, a second filament, a first electrical contact, a second electrical contact, and a switch for selectively connecting one of the first filament and the second filament between the first electrical contact and said second electrical contact.

In accordance with an aspect of the invention, the switch includes a first terminal connected to the first filament, a second terminal connected to second filament, and a wiper rotationally attached to the first or second electrical contact. The wiper may be selectively rotationally positioned to make electrical contact with one of the first terminal and the second terminal.

In accordance with another aspect of the invention, the light bulb has a central axis. A reflector is disposed between the first and second filaments and the first and second electrical contacts. The reflector is oriented perpendicular to the central axis.

In accordance with another aspect of the invention, the light bulb having an enclosure. At least one of krypton gas and xenon gas are disposed within the enclosure.

In accordance with another embodiment of the invention, a light bulb includes a first filament, a second filament, a first electrical contact, and a second electrical contact. The first filament is connected between the first electrical contact and the second electrical contact. A conductor may be used to selectively connect the second filament between the first electrical contact and the second electrical contact should the first filament burn out.

Other aspects of the present invention will become apparent from the following detailed description, taken in conjunction with the accompanying drawings, which illustrate, by way of example, the principles of the invention.

DETAILED DESCRIPTION OF THE INVENTION

Figure 1:
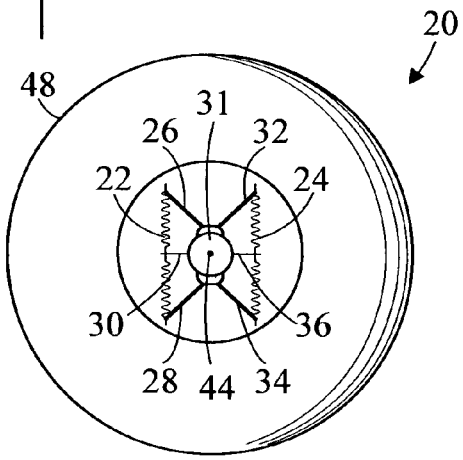
FIG. 1 is top plan view of a light bulb in accordance with the present invention.
Figure 2:
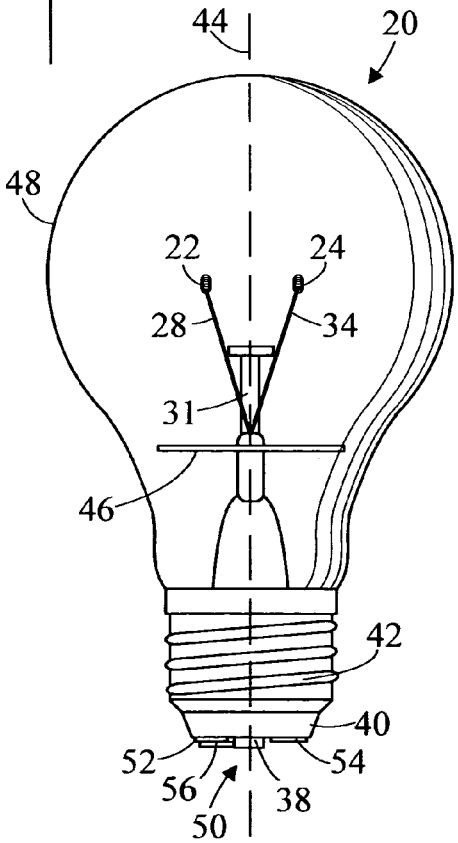
FIG. 2 is a side elevation view of the light bulb.
Figure 3:
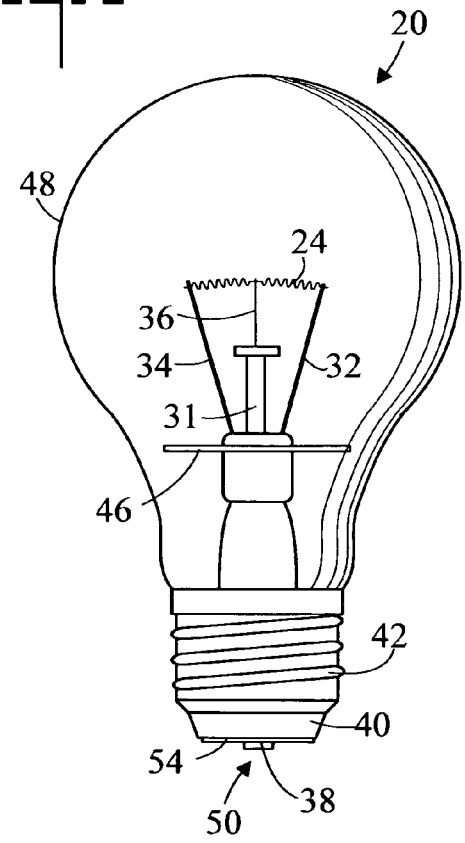
FIG. 3 is front elevation view of the light bulb.

Referring initially to FIGS. 1-3, there are illustrated top plan, side elevation, and front elevation views respectively of an incandescent light bulb in accordance with the present invention, generally designated as 20. Light bulb 20 includes a first filament 22 and a second filament 24, which are typically made from tungsten. First filament 22 is mechanically supported by contact wires 26 and 28, and support wire 30 which emanate from a glass stem 31 in the conventional manner. Similarly, second filament 24 is mechanically supported by contact wires 32 and 34, and support wire 36. The base of light bulb 20 includes a centrally disposed first electrical contact 38 which makes contact with a center conductor in a conventional light bulb socket (not shown), a conventional insulator 40, and a second electrical contact 42. In the shown embodiment second electrical contact 42 includes a conductive threaded sleeve which makes contact with a second conductor in the light bulb socket in the conventional manner. In other words, when light bulb 20 is screwed into the conventional light bulb socket and the socket energized, a voltage is applied between first electrical contact 38 and second electrical contact 42, thereby illuminating light bulb 20.

Light bulb 20 has a central axis 44. A disc-shaped reflector 46 is disposed between first 22 and second 24 filaments and electrical contact 38. Disc-shaped reflector 46 is oriented perpendicular to central axis 44, and increases the light output of light bulb 20 by reflecting light from first filament 22 and second filament 24.

Light bulb 20 has an enclosure 48 (typically made from glass). In the shown embodiment enclosure 48 is clear, but could also be translucent. In an embodiment of the invention, krypton gas is disposed within enclosure 48. This is in contrast to conventional light bulbs which use argon or neon gas. Krypton gas prolongs the life of the filaments because it is a heavy gas. It suppresses the evaporation of tungsten molecules at the 3000 degree filament temperature. The loss of tungsten molecules causes the filament to thin-out and finally break. Krypton gas alleviates this problem. Xenon gas can similarly be disposed within enclosure 48 to achieve the same beneficial effect.

Figure 4:
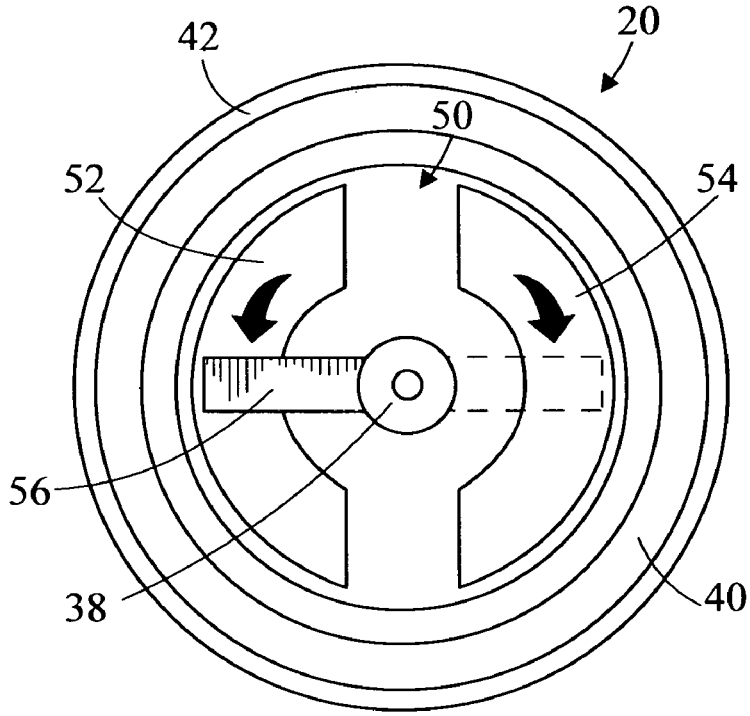
FIG. 4 is an enlarged bottom plan view of the base of the light bulb showing a switch.
Figure 5:
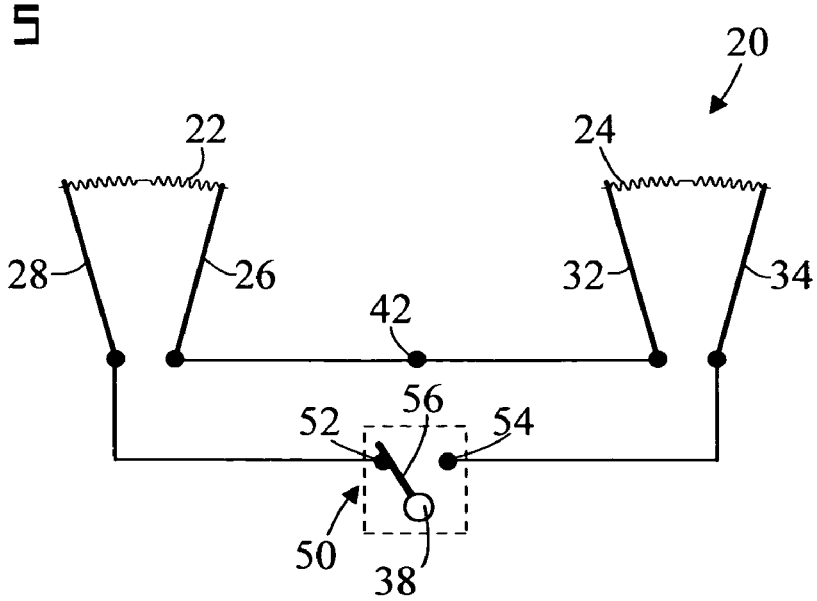
FIG. 5 is a schematic diagram of the light bulb.

Referring also to FIGS. 4 and 5, there are illustrated an enlarged bottom plan view of the base of light bulb 20, and a schematic diagram of light bulb 20. Light bulb 20 includes a switch 50 for selectively connecting one of first filament 22 and second filament 24 between first electrical contact 38 and second electrical contact 42. In the shown embodiment, switch 50 includes a first terminal 52 which is electrically connected to first filament 22, and a second terminal 54 which is electrically connected to second filament 24. A wiper 56 is rotationally attached to and makes electrical contact with first electrical contact 38. Wiper 56 may be selectively rotationally positioned to make electrical contact with one of first terminal 52 and second terminal 54. As shown, wiper 56 has been positioned to make electrical contact with first terminal 52, and therefore when light bulb 20 is screwed into a socket and turned on, first filament 22 will illuminate. Conversely, if wiper 56 is positioned to the dashed position in FIG. 4, then second filament 24 will illuminate. Therefore, if one filament burns out, switch 50 may be used to select the other filament. In FIG. 5 it is noted that the opposite sides of first filament 22 and second filament 24 are connected to second electrical contact 42 (conductive threaded sleeve) thereby completing the electrical circuit.

Figure 6:
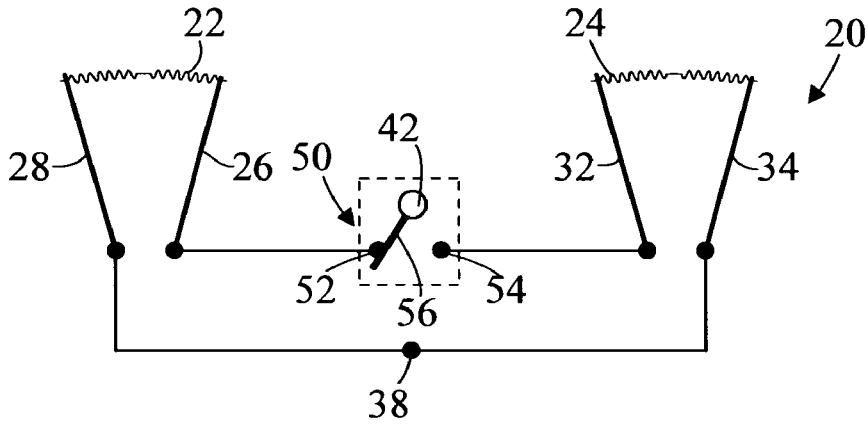
FIG. 6 is a schematic diagram showing a different placement of the switch.

FIG. 6 is a schematic diagram showing a different placement of switch 50. In this embodiment wiper 56 is rotationally attached to and makes electrical contact with second electrical contact 42. That is, the opposite side of the circuit is switched. As in the previous embodiment, wiper 56 may be selectively rotationally positioned to make electrical contact with one of first terminal 52 and second terminal 54.

Figure 7:
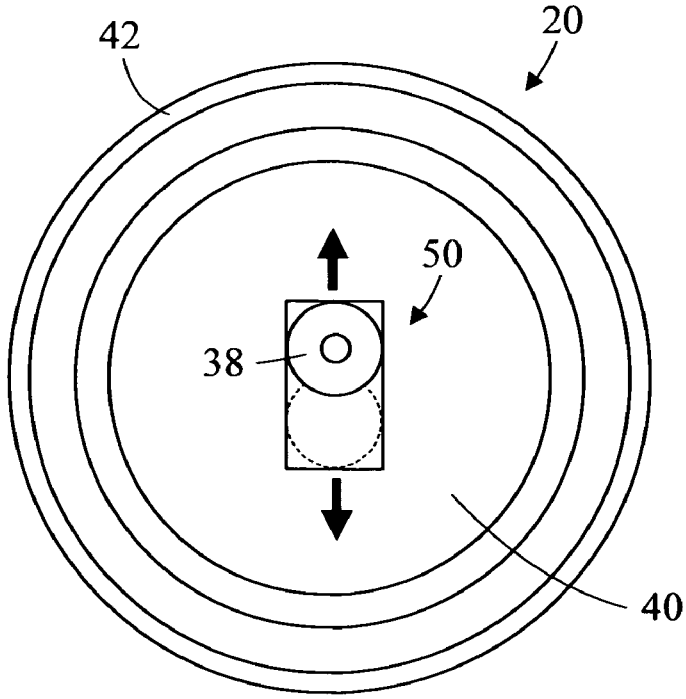
FIG. 7 is an enlarged bottom plan view showing a different switch embodiment.

FIG. 7 is an enlarged bottom plan view of a second embodiment of switch 50. In this embodiment electrical contact 38 is movable up or down to effect the contact with first filament 22 or second filament 24 respectively. It may be appreciated, that other switching arrangements are also possible, all of which are embraced by the principles of the present invention.

In terms of use, a method for prolonging the life of a light bulb includes: (refer to FIGS. 1-7)

(a) providing a light bulb 20 including:

a first filament 22;

a second filament 24;

a first electrical contact 38;

a second electrical contact 42;

a switch 50 for selectively connecting one of first filament 22 and second filament 24 between first electrical contact 38 and second electrical contact 42;

switch 50 positioned to connect one of first filament 22 and second filament 24 between first electrical contact 38 and second electrical contact 42;

(b) providing a light bulb socket connected to a power supply having an on/off control;

(c) positioning switch 50 to connect one of first filament 22 and second filament 24 between first electrical contact 38 and second electrical contact 42. It is noted that the positioning of switch 50 will typically be done by the manufacturer, but could also be done by the consumer.

(d) installing light bulb 20 in the socket;

(e) using the on/off control to turn light bulb 20 on and off a plurality of times;

(f) observing that light bulb 20 will not turn on;

(g) removing light bulb 20 from the socket;

(h) positioning switch 50 to connect the other of first filament 22 and second filament 24 between first electrical contact 38 and second electrical contact 42;

(i) reinstalling light bulb 20 in the socket; and, (j) using the on/off control to turn light bulb 20 on and off a plurality of times.

The method further including:

in step (a), switch 50 including:

a first terminal 52 connected to first filament 22;

a second terminal 54 connected to second filament 24;

a wiper 56 rotationally attached to first electrical contact 38; and, in step (c), ensuring that wiper 56 makes electrical contact with one of first terminal 52 and second terminal 54; and, in step (h) rotating wiper 56 so that it makes electrical contact with the other of first terminal 52 and second terminal 54.

The method further including:

in step (a), switch 50 including:

a first terminal 52 connected to first filament 22;

a second terminal 54 connected to second filament 24;

a wiper rotationally attached to second electrical contact 42; and, in step (c), ensuring that wiper 56 makes electrical contact with one of first terminal 52 and second terminal 54; and, in step (h) rotating wiper 56 so that it makes electrical contact with the other of first terminal 52 and second terminal 54.

Figure 8:
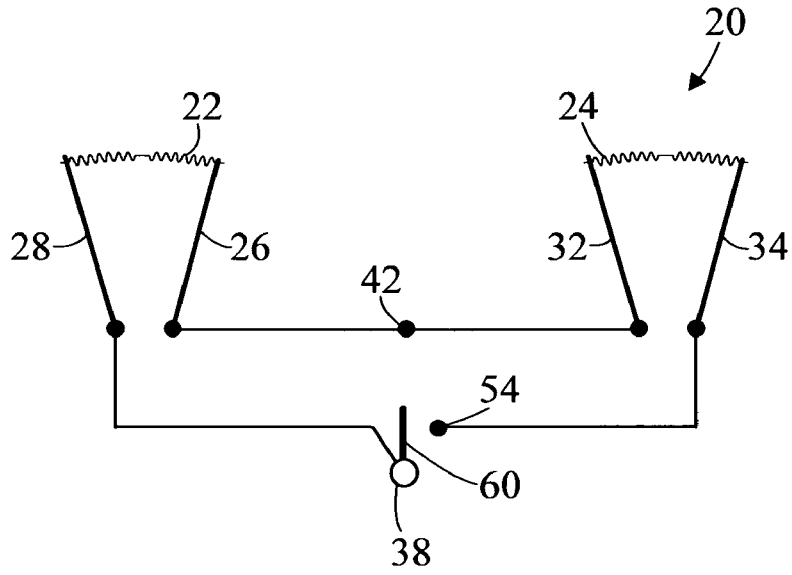
FIG. 8 is a schematic diagram of an alternative embodiment of the invention, showing a conductor in an unconnected position.

FIG. 8 is a schematic diagram of an alternative embodiment of the invention, showing a conductor 60 in an unconnected position. As with the embodiment of FIGS. 1-7, light bulb 20 includes first filament 22, second filament 24, first electrical contact 38, second electrical contact 42, and a terminal 54 connected to second filament 24. However in this embodiment first filament 22 is connected (i.e. hardwired) between first electrical contact 38 and second electrical contact 42. As such, when light bulb 20 is screwed in to a socket, first filament 22 will illuminate. Light bulb 20 also has a conductor 60 for selectively connecting second filament 24 between first electrical contact 38 and second electrical contact 42. In the shown embodiment, conductor 60 includes a wiper which is rotationally attached to and makes electrical contact with first electrical contact 38. Wiper 60 may be selectively rotationally positioned to make electrical contact with terminal 54. It may be appreciated however that conductor 60 could take other forms such as a plug and jack, a wire, a bus bar, a switch, etc., any of which could be used to connected second filament 24 to first electrical contact 38. In FIG. 8 conductor 60 is shown in an unconnected position.

Figure 9:
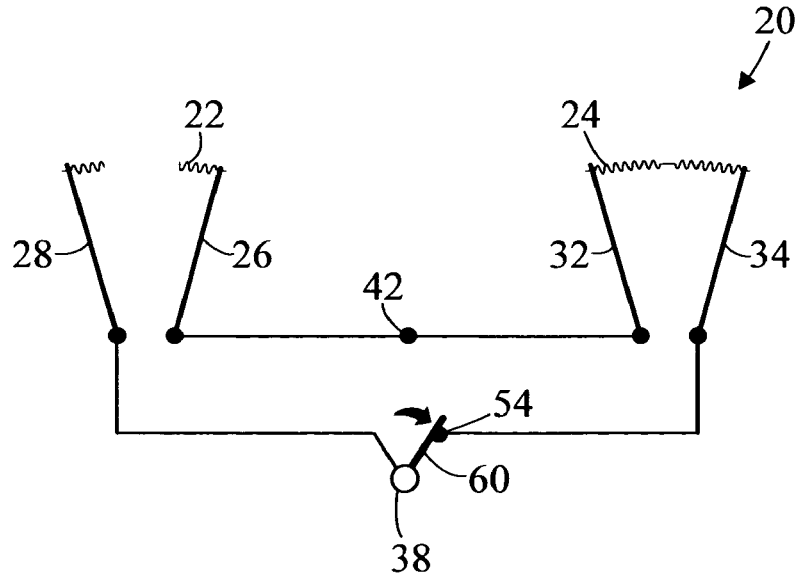
FIG. 9 is a schematic diagram of the alternative embodiment showing the conductor in a connected position.

FIG. 9 is a schematic diagram of the alternative embodiment of FIG. 8 showing conductor 60 in a connected position. In FIG. 9 first filament 22 has burned out (indicated by the open filament wire). When this happens, light bulb 20 can be removed from its socket and connector 60 (wiper) rotated to make electrical contact with terminal 54, thereby connecting second filament 24 between first electrical contact 38 and second electrical contact 42. Light bulb 20 is then reinstalled in its socket and second filament 24 will illuminate.

Figure 10:
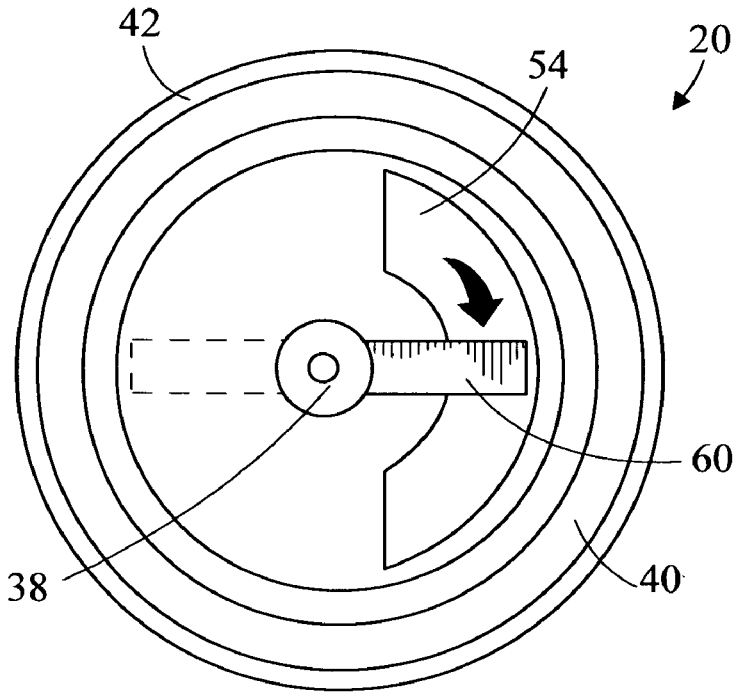
FIG. 10 is an enlarged bottom plan view of the base of the light bulb showing the conductor.

FIG. 10 is an enlarged bottom plan view of the base of light bulb 20 showing conductor 60. Conductor 60 (wiper) is initially in the unconnected position shown in dashed lines. When first filament 22 burns out, conductor 60 is rotated to make electrical contact with terminal 54 and thereby connect second filament 24 between first electrical contact 38 and second electrical contact 42 (refer to FIGS. 8 and 9).

Figure 11:
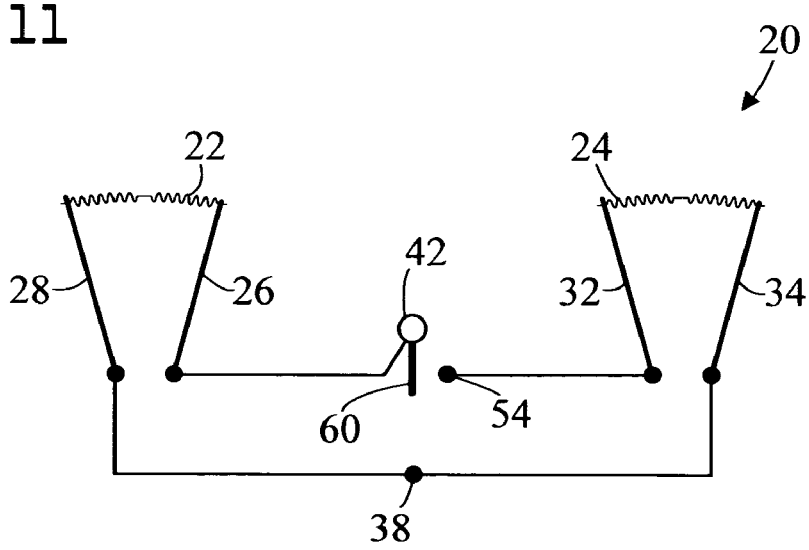
FIG. 11 is a schematic diagram showing a different placement of the conductor.

FIG. 11 is a schematic diagram showing a different placement of conductor 60. In this embodiment conductor 60 includes a wiper which is rotationally attached to second electrical contact 42, and may be selectively rotationally positioned to make electrical contact with terminal 54.

It may further be appreciated that the reflector 46 and Krypton and Xenon gas embodiments may also be applied to the embodiment of FIGS. 8-11.

In terms of use, a method for prolonging the life of a light bulb includes: (refer to FIGS. 8-11

(a) providing a light bulb including:

a first filament 22;

a second filament 24;

a first electrical contact 38;

a second electrical contact 42;

first filament 22 connected between first electrical contact 38 and second electrical contact 42;

a conductor 60 for selectively connecting second filament 24 between first electrical contact 38 and second electrical contact 42;

(b) providing a light bulb socket connected to a power supply having an on/off control;

(c) positioning conductor 60 so that it does not connect second filament 24 between first electrical contact 38 and second electrical contact 42. It is noted that the positioning of conductor 60 will typically be done by the manufacturer.

(d) installing light bulb 20 in the socket;

(e) using on/off control to turn light bulb 20 on and off a plurality of times;

(f) observing that light bulb 20 will not turn on;

(g) removing light bulb 20 from the socket;

(h) positioning conductor 60 to connect second filament 24 between first electrical contact 38 and second electrical contact 42; and, (i) reinstalling light bulb 20 in the socket; and, (j) using the on/off control to turn light bulb 20 on and off a plurality of times.

The method further including:

in step (a), providing a terminal 54 connected to second filament 24;

in step (a), conductor 60 including a wiper rotationally attached to first electrical contact 38, wherein the wiper may be selectively rotationally positioned to make electrical contact with terminal 54;

in step (c), ensuring that the wiper does not make electrical contact with terminal 54; and, in step (h) rotating the wiper so that it makes electrical contact with terminal 54.

The method further including:

in step (a), providing a terminal 54 connected to second filament 24;

in step (a), conductor 60 including a wiper rotationally attached to second electrical contact 42, wherein the wiper may be selectively rotationally positioned to make electrical contact with terminal 54;

in step (c), ensuring that the wiper does not make electrical contact with terminal 54; and, in step (h) rotating the wiper so that it makes electrical contact with terminal 54.

It may be appreciated that light bulb 20 is not limited to two filaments, but could rather include three or more filaments. To that end, light bulb 20 includes a plurality of filaments, a first electrical contact 38, and a second electrical contact 42. One of the plurality of filaments is connected between first electrical contact 38 and second electrical contact 42. Light bulb 20 includes means for connecting another of the plurality of filaments between first electrical contact 38 and second electrical 42 contact when the connected filament burns out.

The preferred embodiments of the invention described herein are exemplary and numerous modifications, variations, and rearrangements can be readily envisioned to achieve an equivalent result, all of which are intended to be embraced within the scope of the appended claims.

We claim:

1. A light bulb comprising:

a first filament;

a second filament;

a first electrical contact;

a second electrical contact;

a switch for selectively connecting one of said first filament and said second filament between said first electrical contact and said second electrical contact, said switch located on said light bulb;

said light bulb having a base, said first electrical contact being centrally disposed on said base;

said switch including:

a first terminal connected to said first filament;

a second terminal connected to said second filament;

a wiper rotationally attached to said first electrical contact; and, wherein said wiper is selectively rotationally positionable to make electrical contact with one of said first terminal and said second terminal.

2. A light bulb comprising:

a first filament;

a second filament;

a first electrical contact;

a second electrical contact;

a switch for selectively connecting one of said first filament and said second filament between said first electrical contact and said second electrical contact, said switch located on said light bulb;

said light bulb having a conductive threaded sleeve, said second electrical contact being connected to said conductive threaded sleeve;

said switch including:

a first terminal connected to said first filament;

a second terminal connected to said second filament;

a wiper rotationally attached to said second electrical contact; and, wherein said wiper is selectively rotationally positionable to make electrical contact with one of said first terminal and said second terminal.

* * * * *